US007395829B2

(12) United States Patent
Chapman

(10) Patent No.: US 7,395,829 B2
(45) Date of Patent: Jul. 8, 2008

(54) SHOCK ABSORBER CRUTCH AND SHOCK ABSORBER KIT

(76) Inventor: Richard R. Chapman, 816 Duplex Ave., Toronto, Ontario (CA) M4R 1W7

( * ) Notice: Subject to any disclaimer, the term of this patent is extended or adjusted under 35 U.S.C. 154(b) by 64 days.

(21) Appl. No.: 11/447,015

(22) Filed: Jun. 6, 2006

(65) Prior Publication Data

US 2007/0277865 A1 Dec. 6, 2007

(51) Int. Cl.
*A45B 9/04* (2006.01)
*A61H 3/02* (2006.01)

(52) U.S. Cl. ..... 135/82; 135/68

(58) Field of Classification Search ..... 135/71–73, 135/82, 68, 74, 75; 267/177, 179, 70; 482/77, 482/75

See application file for complete search history.

(56) References Cited

U.S. PATENT DOCUMENTS

| | | | | | |
|---|---|---|---|---|---|
| 1,336,844 | A * | 4/1920 | Klousnitzer | ..... | 135/82 |
| 1,548,889 | A * | 8/1925 | King | ..... | 135/82 |
| 2,449,509 | A * | 9/1948 | Richards | ..... | 135/80 |
| 2,554,653 | A * | 5/1951 | Wisecarver | ..... | 135/68 |
| 3,701,544 | A * | 10/1972 | Stankovich | ..... | 280/276 |
| 3,715,000 | A * | 2/1973 | Ottoway | ..... | 180/8.1 |
| 4,162,064 | A * | 7/1979 | Bouton et al. | ..... | 267/177 |
| 4,736,983 | A * | 4/1988 | Furbee | ..... | 297/209 |
| 5,722,645 | A * | 3/1998 | Reitter | ..... | 267/177 |
| 6,286,529 | B1 | 9/2001 | Olivera | | |
| 6,816,745 | B1 * | 11/2004 | Brand et al. | ..... | 607/37 |
| 2004/0025923 | A1 * | 2/2004 | Garza et al. | ..... | 135/68 |
| 2007/0023072 | A1 * | 2/2007 | Agnello et al. | ..... | 135/65 |

* cited by examiner

*Primary Examiner*—David R Dunn
*Assistant Examiner*—Kaitlin A Wilson

(57) ABSTRACT

A shock absorber conversion kit, for a crutch of the type having a tubular main body and an extension member secured to and fitting within the main body, the kit having a first abutment attachable to the main body, a second abutment attachable to the extension member, a resilient device which can be positioned between the first abutment and second abutment, so that pressure on the main body will cause telescoping movement of the extension member into the main body and will stress the resilient device, and release of pressure will permit movement of the extension member out of the main body and will relax such stress. Also disclosed is a shock absorber crutch in which an extension member is slidable into and out of a main body, and is controlled by a resilient action.

9 Claims, 9 Drawing Sheets

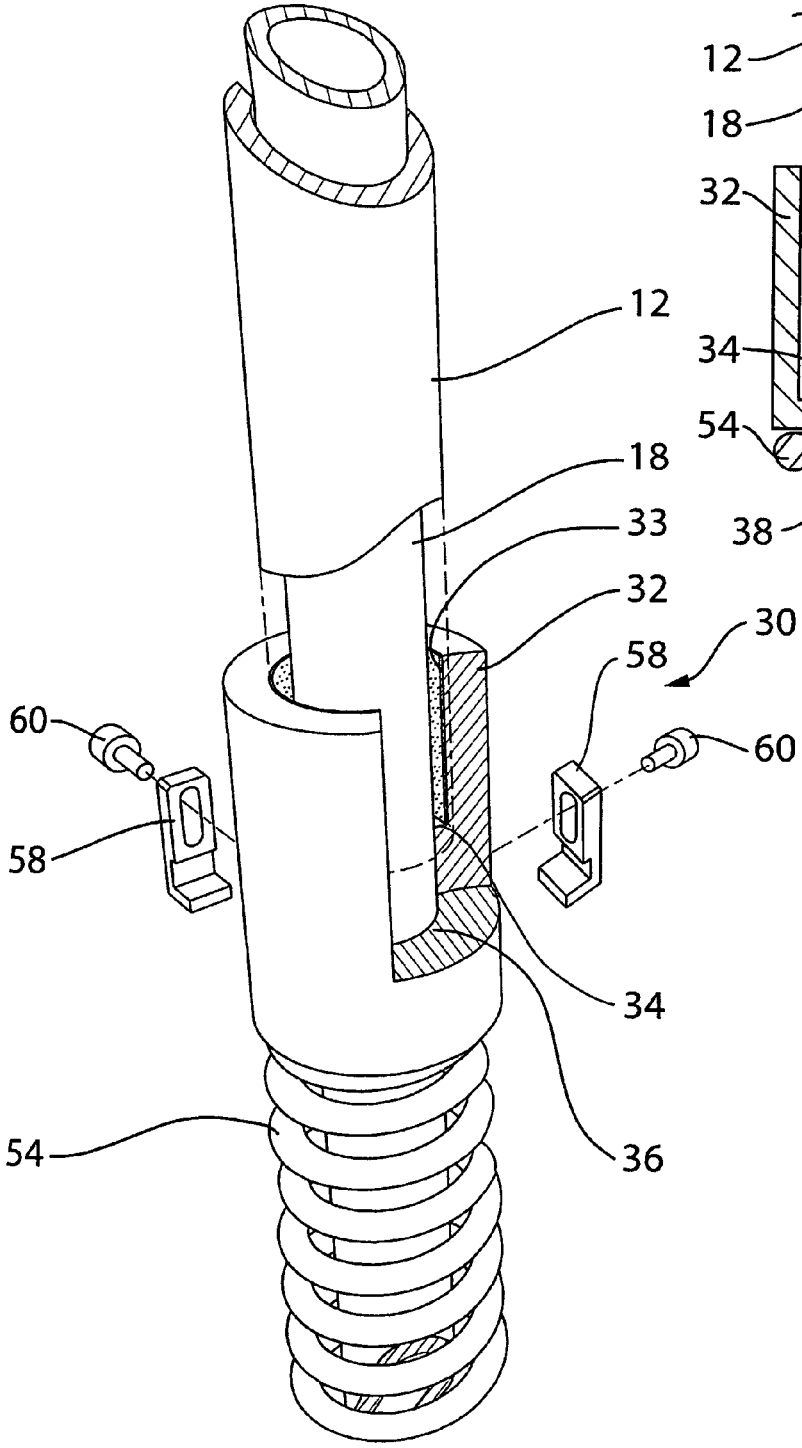
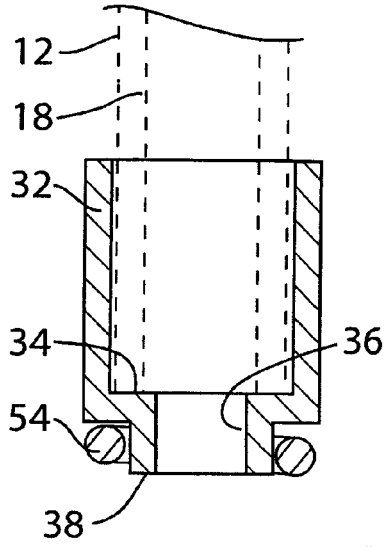
FIG. 3b
FIG. 3a

SHOCK ABSORBER CRUTCH AND SHOCK ABSORBER KIT

FIELD OF THE INVENTION

Invention relates to shock absorber crutch and to a resilient conversion kit for a crutch and, in particular, for a conversion kit which may be used to convert an existing rigid crutch to a crutch with a resilient leg for a shock absorber.

BACKGROUND OF THE INVENTION

Crutches are made either to fit under the armpit, or somewhat shorter crutches are made to fit on the forearm. In both types of crutch, it is common to make the main body of the crutch out of a tubular metal and an extendible crutch is received within the main body. The extendible leg can be secured at various different extensions from the main body to accommodate persons of different heights.

Crutches of this type are usually equipped with a rubber cap at the lower end of the leg extension for engaging the ground. They may also be equipped with various resilient padding members on the armpit support or on the hand support. These pads are designed to absorb the shock of the crutch hitting the ground. However, these various expedients have little effect on the impact of the crutch, and do not do much to increase its comfort in use.

In the past, there have been various attempts to provide a crutch with a spring-loaded leg. The intention behind these proposals is to reduce the shock of the impact of the crutch on the ground. Examples of such proposals are shown in various earlier U.S. Letters Patent.

While these various proposals would have been more or less effective for the purpose intended, they would have required the user to purchase new crutches equipped with the spring-loaded feature and discard the existing rigid crutches. The resulting expense of this would have substantially interfered with the sales and use of such spring-loaded crutches. In fact, few examples can be found of such spring-loaded crutches ever having been in use, notwithstanding their significant advantages.

Clearly, however, the principal disadvantage of these proposals would be overcome by providing a conversion kit which enables the owner of an existing standard type rigid crutch to convert it to a resilient or spring-loaded crutch. The provision of such a kit presents certain obvious difficulties. It must be capable of being readily understood and assembled by unskilled persons or even by persons with some degree of infirmity or disability. It must be a kit such that it can be attached to an existing rigid crutch without the need for any special machining, welding or other sophisticated fastening means. Finally, the kit must be such that it has only a minimum number of parts so that it can be manufactured and sold at a reasonable price.

For simplicity, regular coil springs can be used in the kit for resilience. However, other devices can provide a degree of resilience. These may include a rubber sleeve, an hydraulic device, or pneumatic device, or a synthetic member such as polyurethane or the like. Conceivably, some form of magnetic device might also be used for the purpose.

BRIEF SUMMARY OF THE INVENTION

With a view to providing such a kit, for a crutch of the type having a tubular main body and an extension member secured in the main body, the kit having a first abutment attachable to the main body, a second abutment attachable to the extension member, and a resilient device which can be positioned between the first and second abutment, whereby pressure on the main body will cause telescoping movement of the extension into the main body and will stress the resilient device and release of pressure will permit movement of the extension out of the main body will relax such stress.

Preferably, the first abutment is a collar having a recess to receive the end of the main body and an opening to receive the extension member therethrough.

Preferably, the second abutment is a collar having an opening to receive the extension member.

Preferably, the resilient device is a spring.

Preferably, the first abutment may be secured to the main body by a bonding agent such as, for example, adhesive.

The first abutment may be cylindrical, or other shape and in one piece. The second abutment is preferably made in two segments adapted to fit around the extension member and fastenings for clamping the two segments together.

The spring may be held by any suitable clamps, for example, simple hooks bolted to or formed integrally on the collars.

Preferably the second abutment is secured to the extension member by a clamping action and is locate-able at various positions along the extension member.

The invention also provides a shock absorber crutch which may be sold as a new crutch to a person who does not already have an older type rigid crutch.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

FIG. 3A is a cut away perspective of the upper end of the kit;

FIG. 3B is a section along 3B-3B of FIG. 2;

DESCRIPTION OF A SPECIFIC EMBODIMENT

Figure 1:
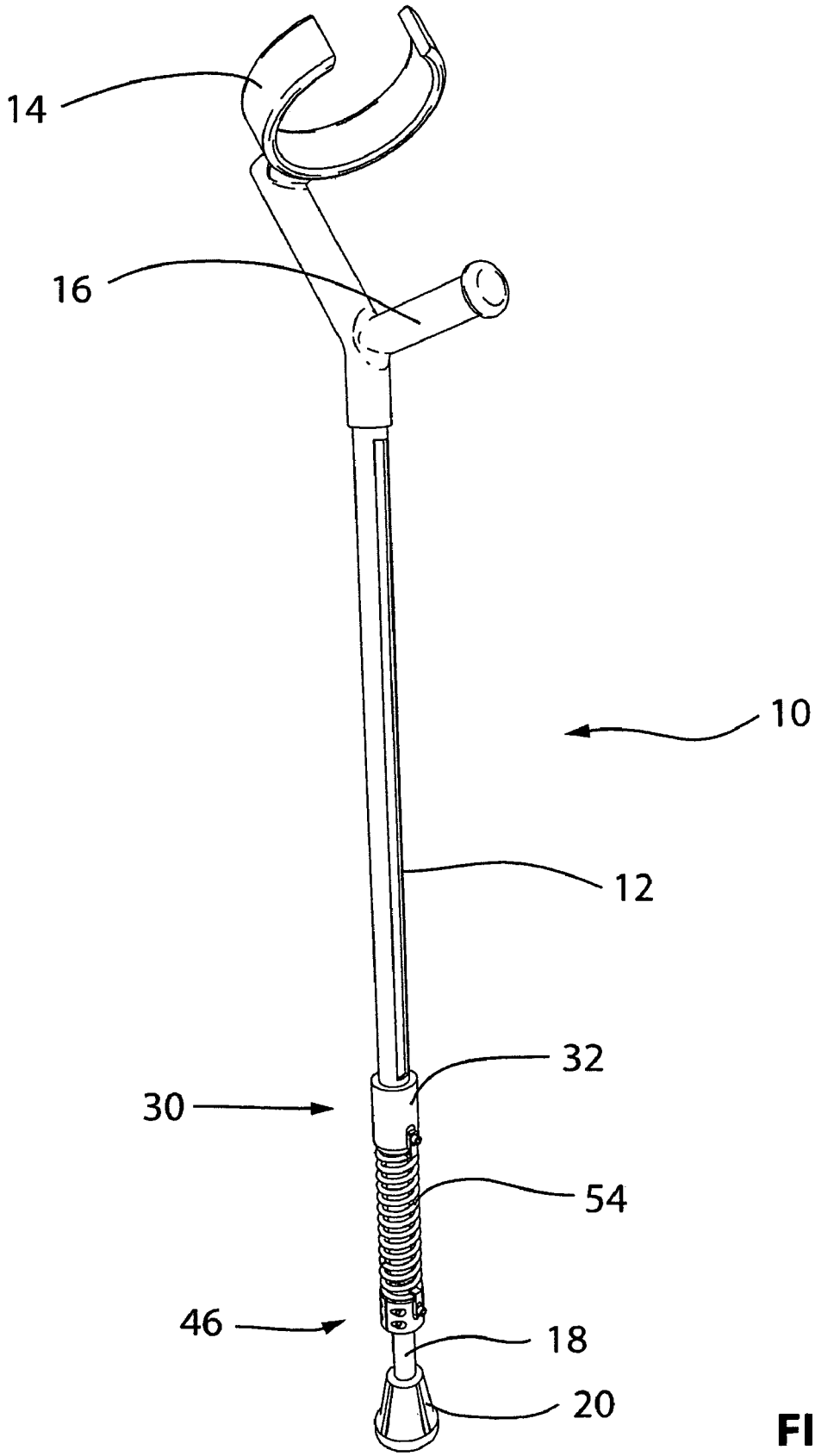
FIG. 1 is a perspective of a typical crutch, modified with a crutch shock absorber kit illustrating the invention attached thereto.
Figure 2:
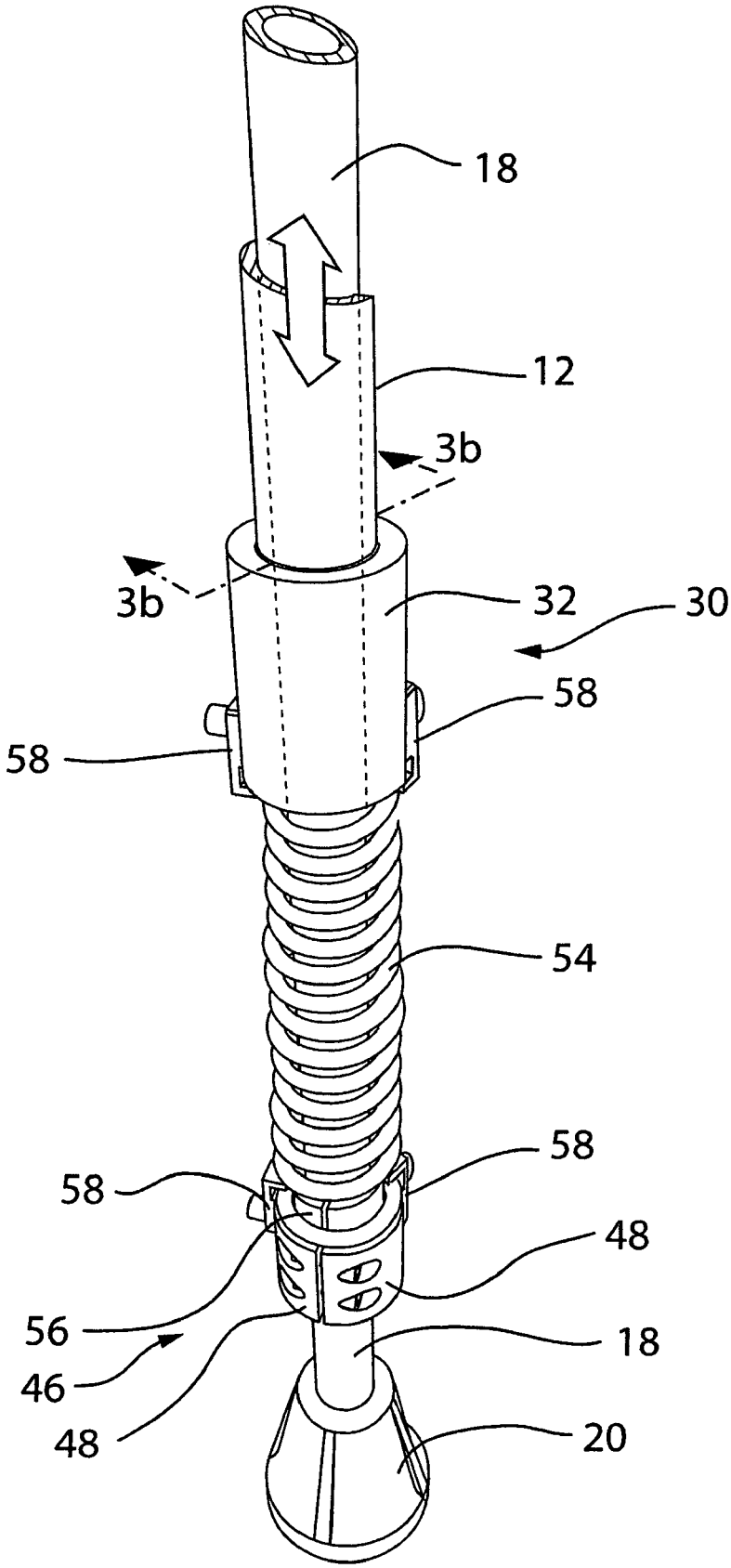
FIG. 2 is a view of the crutch shock absorber kit with parts of the crutch shown in phantom.
Figure 4:
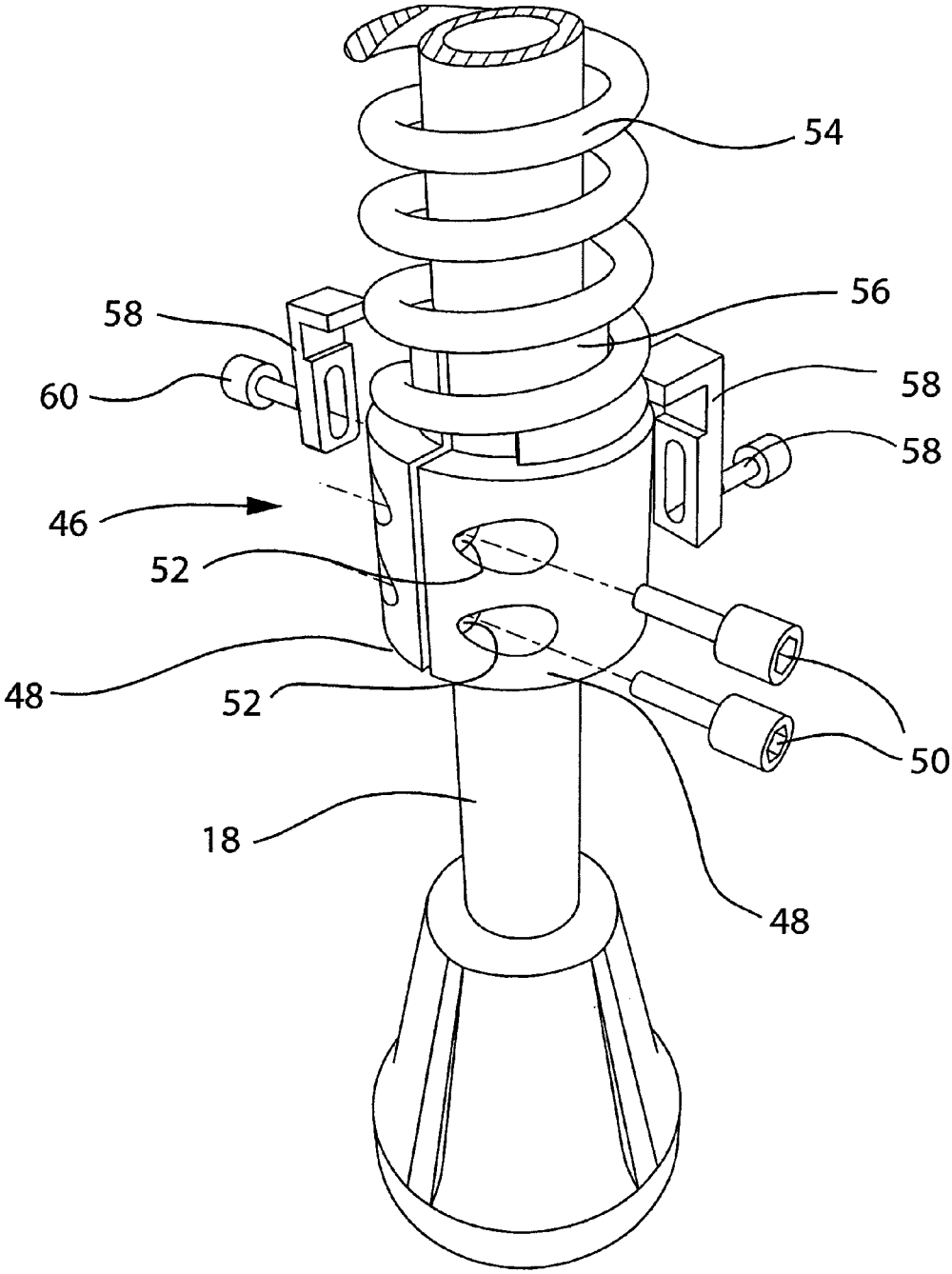
FIG. 4 is an exploded view of the lower end of the crutch shock absorber kit.

As shown generally in FIG. (1) a typical crutch (10) has a main body (12) and a cuff (14) and handle (16). Main body (12) is of tubular material. An extension member (18) also of tubular material in most cases, is received within main body (12).

Preferably the tubular material is metallic, as is commonly used in extendible crutches. In the conventional crutch, the extension member (18) has a series of transverse holes (not shown). Main body (12) has a hole. A releasable fastening (not shown) may pass through the holes (not shown). In this way the length of extension member (18) extending from main body (12) can be adjusted to suit persons of varying height. A rubber cap (20) is provided to reduce slippage.

This has so far described a typical extendible crutch. This is a forearm crutch. The kit provided in this particular embodiment of the invention (FIGS. 2, 3A,3B & 4) consists of an abutment such as a main body collar (30) which is adapted to be secured to the lower end of the main body (12). The main body collar (30) is formed as a cylindrical sleeve (32), and is of generally cylindrical shape. Sleeve (32) defines an interior ledge (34), and a reduced diameter portion (36) for reasons to be described. An exterior boss (38) is formed on sleeve (32) for reasons described below. The interior ledge (34) rests against the lower end of the main body portion (12), and takes the thrust load in a manner described below. The sleeve (32) is secured to the main body (12) by any suitable form of bonding agent such as adhesive (33) or the like which will be applied to the lower end of the main body (12) for the purpose. Extension member (18) is received in reduced diameter portion (36) and can slide in and out in a telescopic fashion.

In this way, the main body collar is secured in position on the end of the main body without any fastenings passing through the interior of the main body which would otherwise interfere with the operation of the kit for reasons described below.

It will be appreciated that the adhesive does not take of the thrust load on the main body collar (30) but simply assists in retaining it against displacement from the main body (12). The load is taken on the ledge (34).

The kit further comprises a second abutment (FIG. 4) in the form of an extension member collar (46), shaped and adapted to be secured to the extension member (18). The collar (46) comprises two segments (48-48), each of which defines a longitudinal interior smooth semi-cylindrical recess, for fitting around the exterior of the extension member (18).

Any suitable fastenings such as bolt(s) (50) may be passed through two openings (52) in respective segments (48). Segments (48) are thus clamped securely around extension member (18). Collar (46) may be located-up or down on extension member (18) to adapt to persons of varying stature.

Any resilient means may extend between the main body collar (30) and the extension member collar (46). In this case, the resilient means consists of a coil spring (54). The upper end of the spring (54) fits on boss (38) on the main body collar (30). The lower end of the spring (54) fits on a boss (56) on the collar (46).

The two ends of the spring (54) are secured in position on their respective collars, by any suitable means such as L-shaped metal clamps (58) and bolts (60). Any other form of clamping or attachment means could be substituted, (see FIGS. 6A, 6B, 7 & 8) which would provide the same function.

Figure 5A:
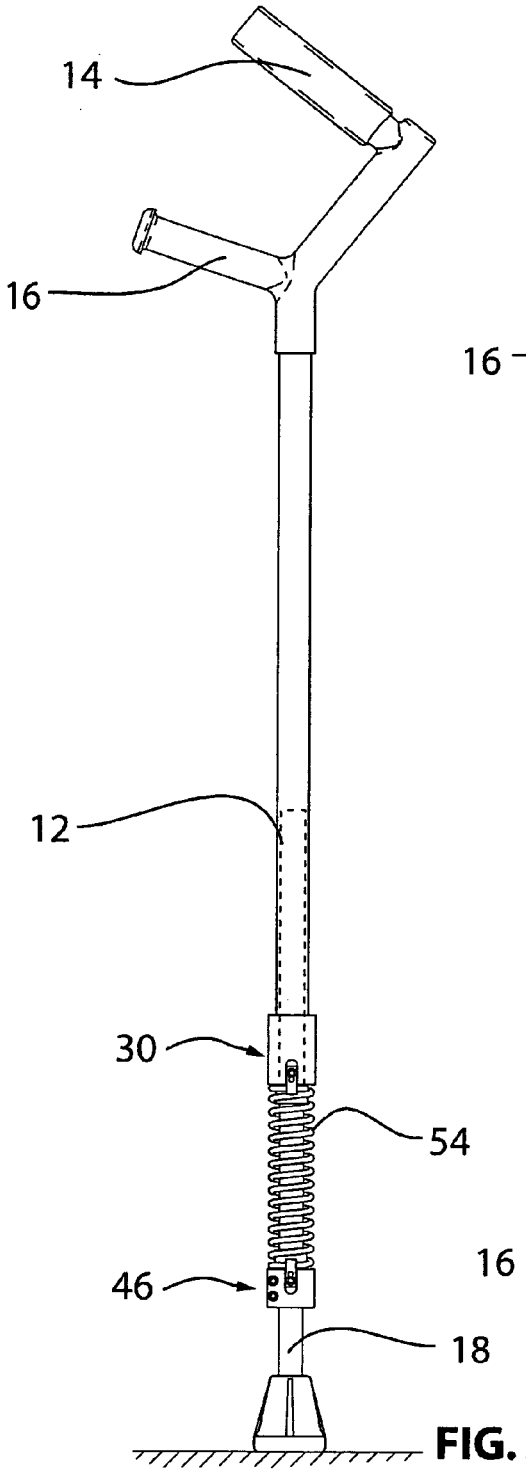
FIGS. 5A and 5B are two elevations of the crutch, with the crutch shock absorber kit in extended and compressed positions.
Figure 5B:
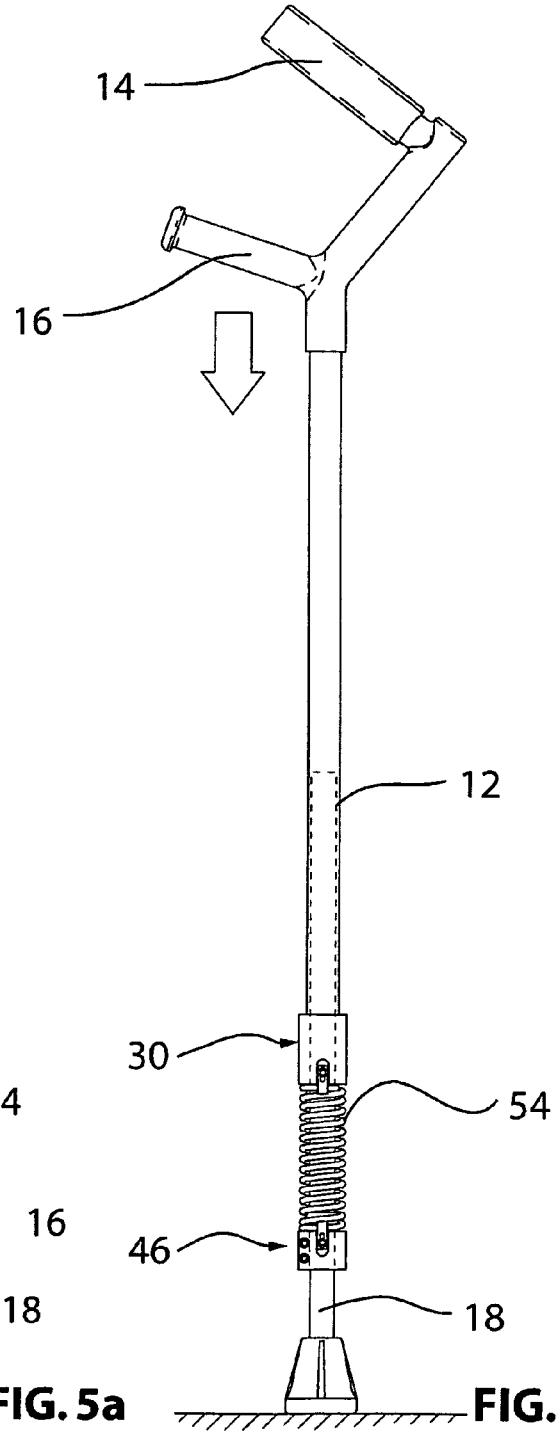

In operation it will be seen that when weight is applied to the main body (12), (FIGS. 5A and 5B) the spring (54) will be stressed and will compress. This will permit the extension member (18) to telescope into the main body (12). When weight is released, the stressing of the spring (54) will be relaxed and it will extend thereby partially extending the extension member (18) from the main body (12).

In this way, a substantial degree of resilience is provided in the crutch (10), rendering the crutch (10) more convenient to use and reducing the shock impact of contact with the ground every time the crutch is used.

As mentioned other resilient devices can replace the spring.

Figure 6A:
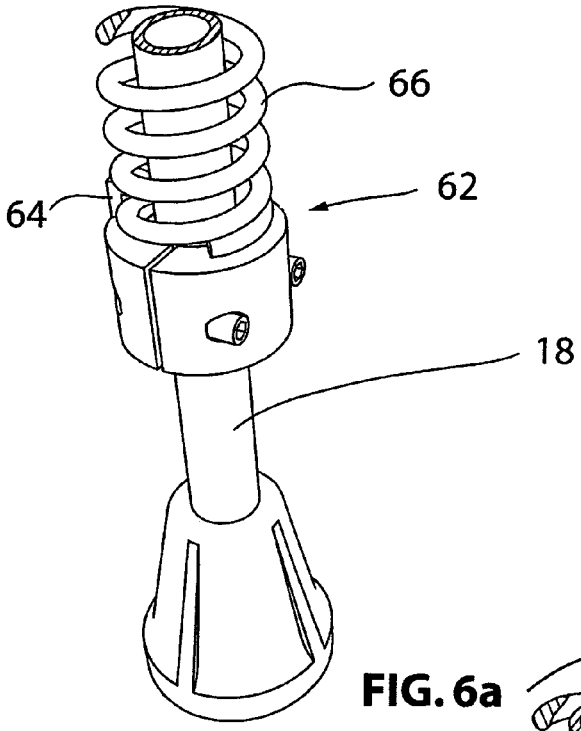
FIG. 6A is a perspective of an alternate form of extension member collar.
Figure 6B:
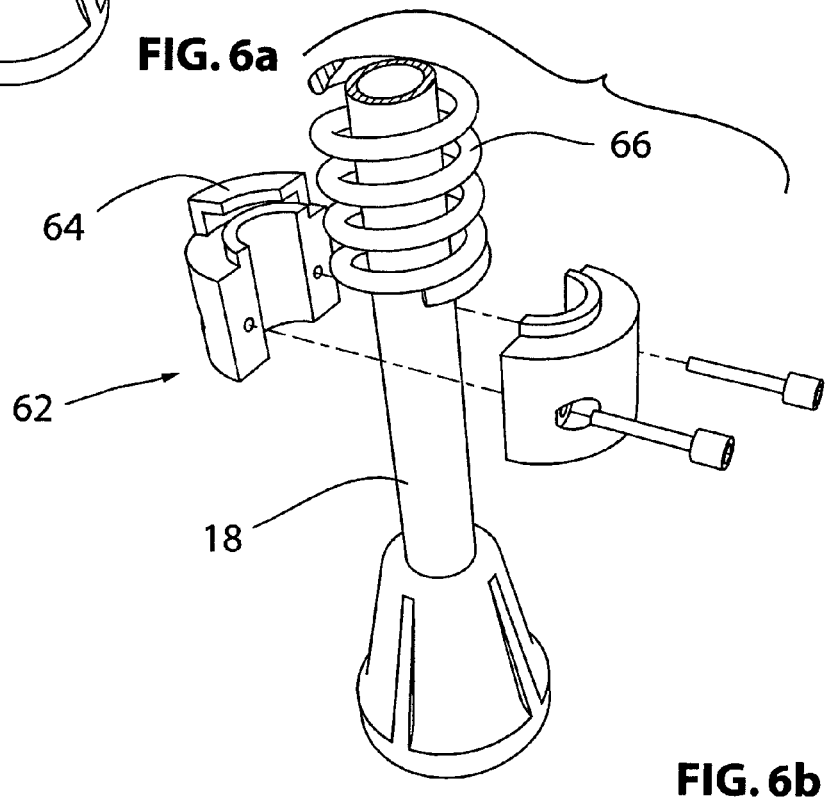
FIG. 6B is an exploded perspective of FIG. 6A.
Figure 6C:
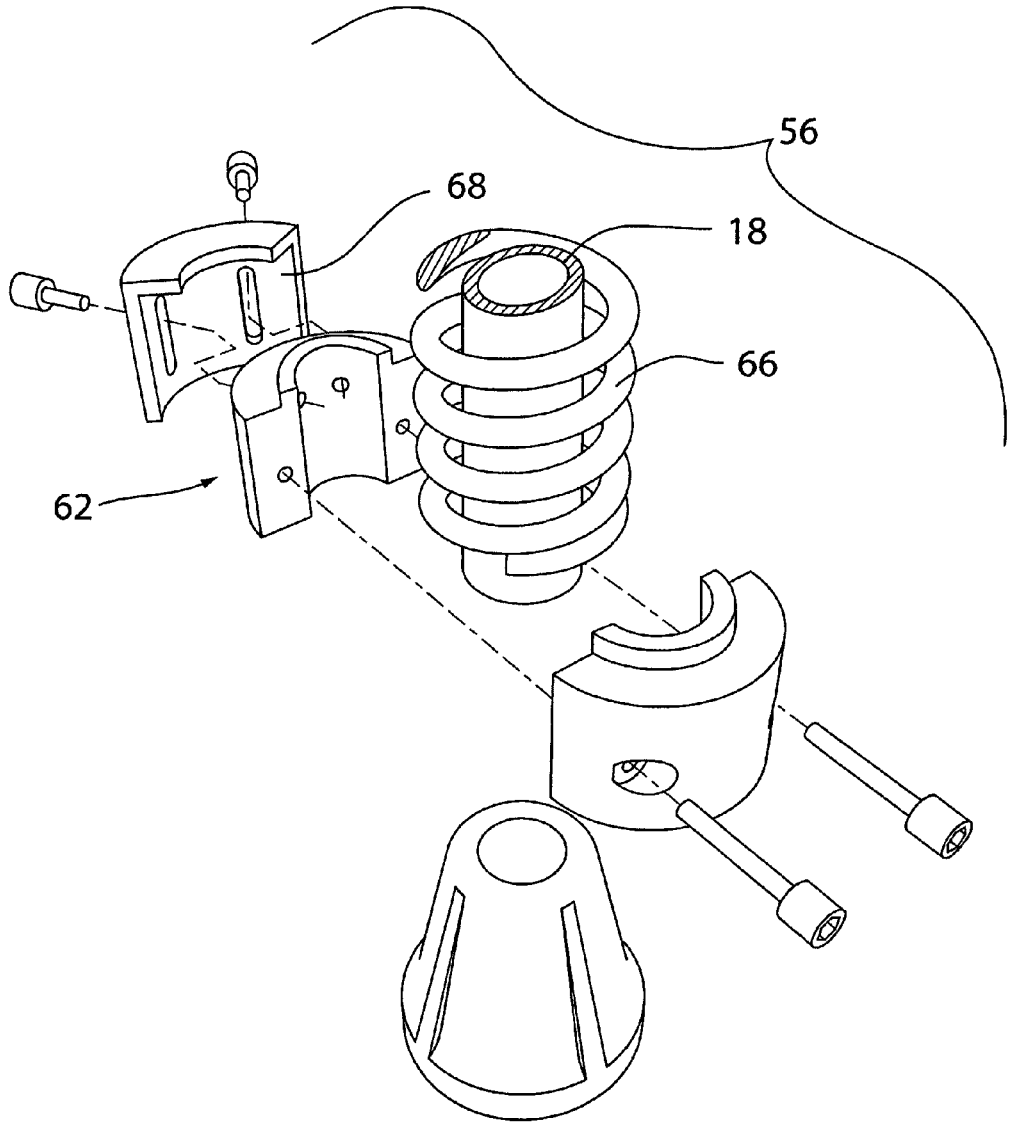
FIG. 6C is an exploded perspective of a modification of FIGS. 6A and 6B.

Other forms of spring attachment can replace the forms of attachment described above. FIGS. 6A and 6B illustrates a modified form of extension member collar (62). Collar (62) is formed in two segments, one of which incorporates an integral annular semi arcuate hook (64). Hook (64) capture the end of the spring (66) thereby avoiding the use of clamps (58). Hook (64) will typically extend around 90 degrees to 120 degrees. A further modification (FIG. 6C) can provide a clamp cuff (68) attachable to one of the segments of collar (62).

Figure 7:
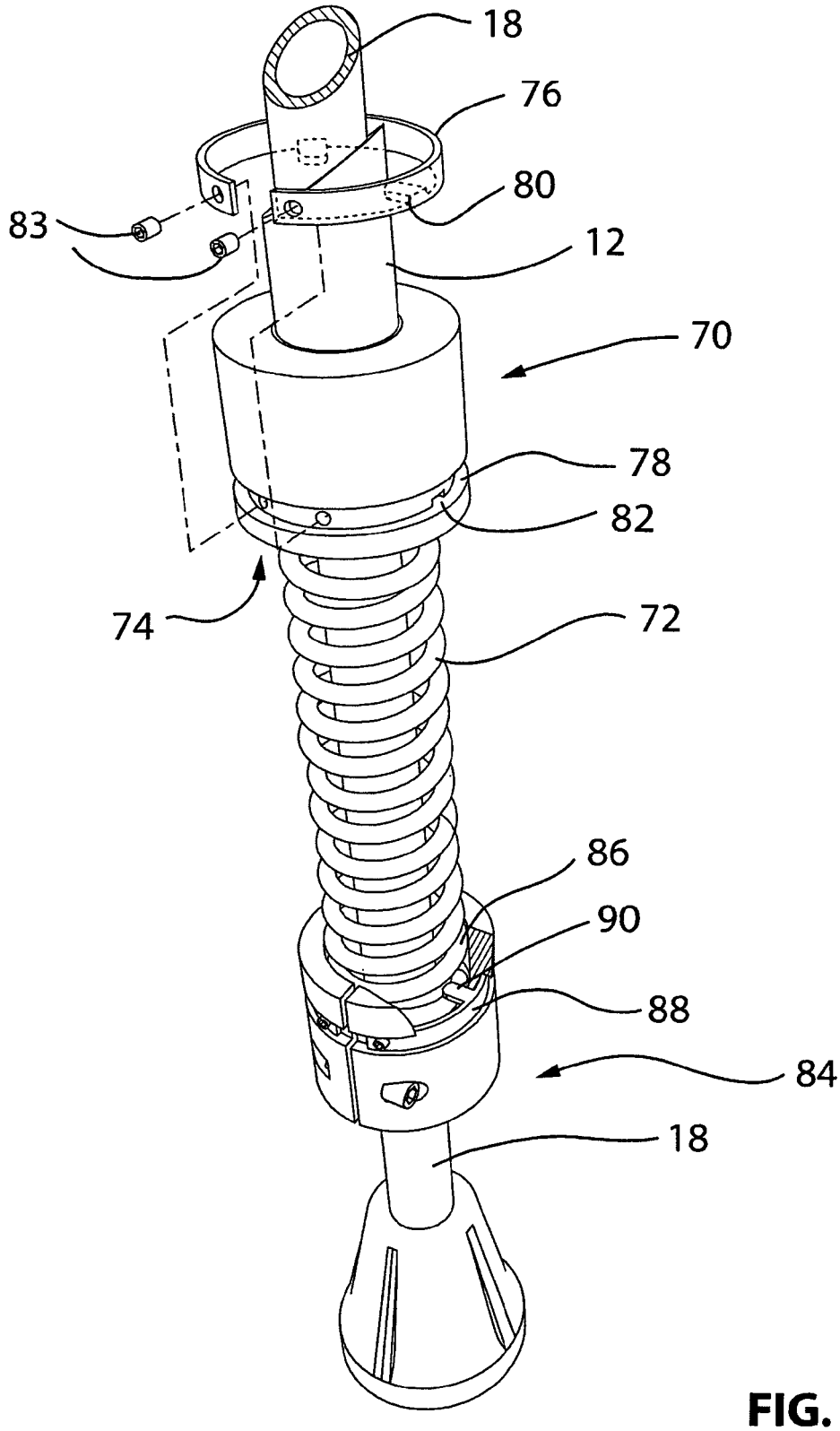
FIG. 7 is a perspective of an alternate form of main body collar.

A further embodiment is shown in FIG. 7. In this case, a main body collar (70) is a cylindrical sleeve with internal ledge as before. The spring (72) fits within a cylindrical counter bore (74) in collar (70). A spring lock ring (76) fits within a groove (78) in collar (70). Ring (76) has a lip or lips (80). Lip (80) extends through a slot (82) in collar (70) and engages the spring (72) and locks it in the counter bore (74). Bolts (83) secure the ring (76).

The extension collar (84) may be of two segments, as before, but also has a counter bore (86) and a lock ring and bolts (88) and lip (90) and groove (not shown). These function in the same fashion to lock the spring (72).

The kit therefore provides a simple economical and highly effective way of converting an existing rigid crutch (10) into a resilient extension crutch. The owner of the crutch simply buys the kit, attaches it to his crutch using the simple forms of attachment provided. He does not have to buy another crutch and discard his old one.

An armpit crutch, and even some walking canes may be made of similar materials. The term crutch may be considered as covering all such crutches and other walking aids. The invention provides a kit which may possibly be used to convert such a crutch into a resilient crutch.

Figure 8:
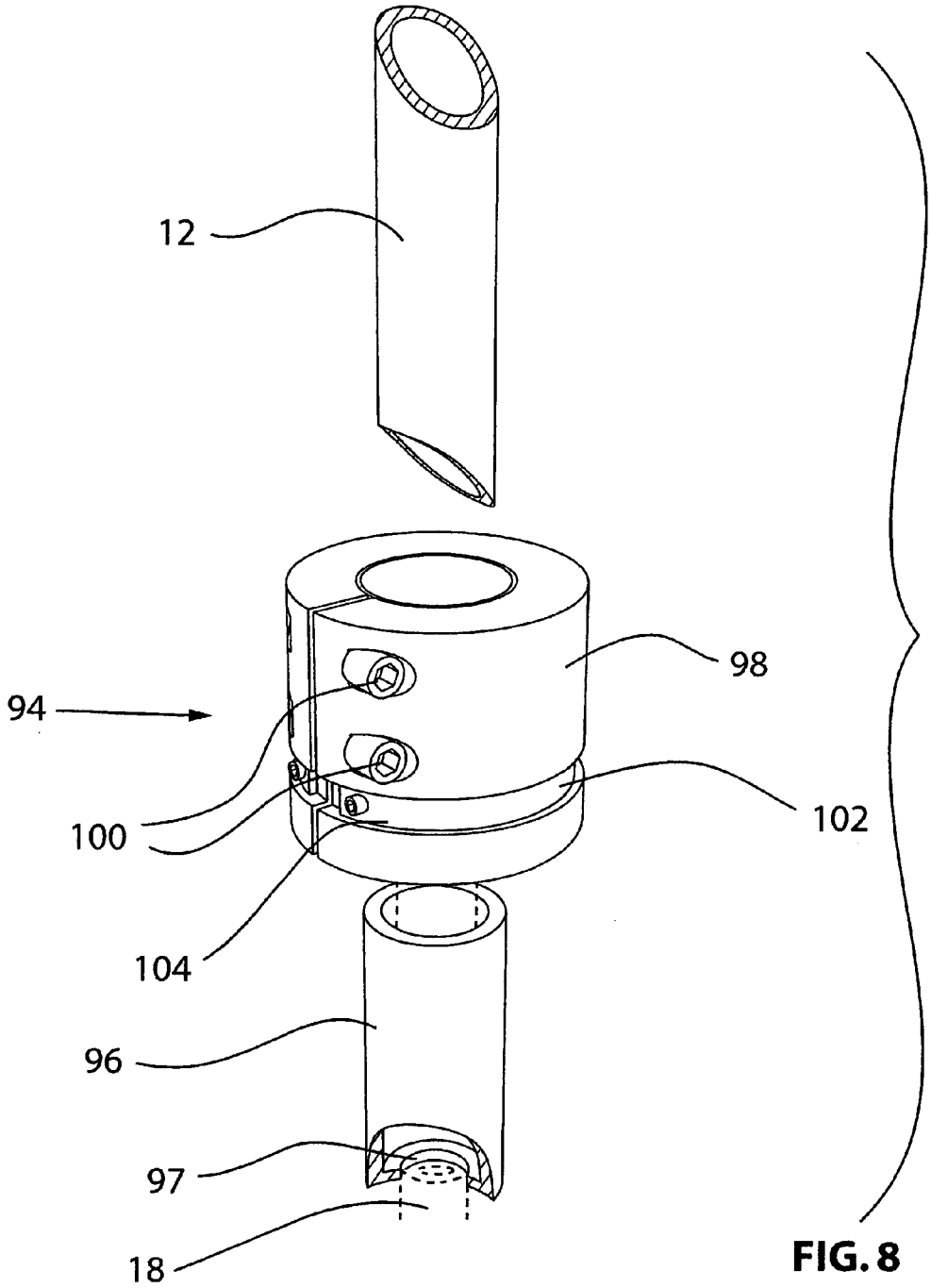
FIG. 8 is a perspective of another alternate form of collar.

A further embodiment of collar is shown in FIG. 8. In this case, the main body collar (94) has an inner cylindrical sleeve (96) with a ledge (97) to engage the main body (12) bonded on the main body by an adhesive.

A split cuff (98) fits on sleeve (96). Bolts (100) clamp the cuff (98) on the sleeve (96). A clamp ring (102) is provided to clamp the spring (not shown) fitting in groove (104), similar to groove (78) of FIG. 7. The lower end of cuff (98) has a counterbore (not shown) to receive the upper end of the spring.

Collars can also be adapted with threaded locks (not shown) to engage the spring ends. Collars can also incorporate a rotary bearing to engage the spring end. This will permit rotation of the extension member relative to the main body.

It will be appreciated that while the invention is described in terms of a kit for converting an existing rigid crutch into a shock absorber crutch, the invention may also be used to produced a complete shock absorber crutch. Such a complete crutch may have considerable appeal to a person obliged for the first time to buy a new crutch, or to a person who finds it necessary to reequip with a new crutch for some reason.

Such a complete shock absorber crutch is therefor deemed within the scope of the invention.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A kit for a crutch having a tubular main body of a first predetermined diameter defining a lower end of said tubular main body and an extension member of a second predetermined diameter able to freely telescopically slide into and out of said tubular main body, said kit comprising:

a sleeve attachable to said lower end of said tubular main body; a recess in said sleeve to receive said lower end of said tubular main body;

an opening in said sleeve to receive said extension member therethrough;

an interior ledge formed inside said sleeve between said recess and said opening to engage against said lower end of said tubular main body;

an extension boss extending from said sleeve around said opening;

a collar attachable to said extension member, in turn comprising:

at least two segments each defining a longitudinal interior smooth semi-cylindrical recess;

fastenings for clamping the two said segments together around said extension member;

a reduced diameter semi-cylindrical formation extending from each said segment and;

a resilient device positioned on said boss of said sleeve and on said formation of said collar whereby pressure on said tubular main body will cause telescoping movement of said extension member into said tubular main body and will stress the said resilient device, and release of pressure will permit movement of said extension member from said tubular main body and will relax such stress.

2. A kit as claimed in claim 1 wherein the resilient device is a spring.

3. A kit as claimed in claim 1 wherein said sleeve may be secured to the main body by a bonding agent.

4. A kit as claimed in claim 2 including at least two L-shanked metal clamps bolted to said sleeve and securing said resilient device thereto and at least two L-shaped metal clamps bolted to said collar to secure said resilient device.

5. A kit as claimed in claim 2 wherein said collar defines exterior arcuate portions for engaging portions of the ends of said spring.

6. A shock absorber crutch having a telescoping resilient action for absorbing the shock of engaging a surface and comprising;

a tubular main body of a first predetermined diameter and having a lower end;

an extension member of a second predetermined diameter fitting within said tubular main body able to freely telescopically slide into and out of said tubular main body;

a sleeve attached to said lower end of said tubular main body and secured to said tubular main body and in turn comprising:

a recess in said sleeve to receive said lower end of said tubular main body;

an opening in said sleeve to receive said extension member therethrough;

an interior ledge formed inside said sleeve between said recess and said opening to engage against said lower end of said tubular main body; and an extension boss extending from said sleeve around said opening;

a second abutment collar attached to said extension member in turn comprising:

at least two segments each defining a longitudinal interior smooth semi-cylindrical recess; and fastenings for clamping the two said segments together around said extension member and;

a resilient device positioned between said sleeve and said collar, whereby pressure on said tubular main body will cause telescoping movement of said extension member into said tubular main body and will stress the resilient device, and release of pressure will permit movement of said extension member from said tubular main body and will relax such stress.

7. A shock absorber crutch having a telescoping resilient action as claimed in claim 6 wherein the resilient device is a spring.

8. A shock absorber crutch having a telescoping resilient action as claimed in claim 7 wherein said collar defines exterior arcuate portions for engaging portions of the ends of the spring.

9. A shock absorber crutch having a telescoping resilient action as claimed in claim 6 wherein at least two L-shaped metal clamps are bolted to said sleeve and said collar to secure said resilient device.

* * * * *